US008308384B2

(12) United States Patent
Zhang

(10) Patent No.: US 8,308,384 B2
(45) Date of Patent: Nov. 13, 2012

(54) PRESSABLE PEN

(75) Inventor: Jun Zhang, Zhuhai (CN)

(73) Assignee: Unique Design Packaging Co., Ltd., Guang Dong (CN)

( * ) Notice: Subject to any disclaimer, the term of this patent is extended or adjusted under 35 U.S.C. 154(b) by 339 days.

(21) Appl. No.: 12/810,163

(22) PCT Filed: Nov. 3, 2008

(86) PCT No.: PCT/CN2008/070460

§ 371 (c)(1), (2), (4) Date: Jun. 23, 2010

(87) PCT Pub. No.: WO2009/111914

PCT Pub. Date: Sep. 17, 2009

(65) Prior Publication Data

US 2010/0284725 A1 Nov. 11, 2010

(51) Int. Cl.
*B43K 5/06* (2006.01)

(52) U.S. Cl. ..... 401/174; 401/171; 401/172

(58) Field of Classification Search ..... 401/171, 401/172, 173, 174, 68, 86, 87
See application file for complete search history.

(56) References Cited

U.S. PATENT DOCUMENTS

| | | | | |
|---|---|---|---|---|
| 6,688,796 | B1 * | 2/2004 | Liu | 401/277 |
| 6,702,158 | B2 * | 3/2004 | Kageyama et al. | 222/386 |
| 6,752,558 | B1 | 6/2004 | Hsu | |
| 7,677,828 | B2 | 3/2010 | Tani | |
| 8,021,068 | B2 * | 9/2011 | Shih | 401/277 |
| 2009/0162130 | A1 | 6/2009 | Miyazaki et al. | |

FOREIGN PATENT DOCUMENTS

| | | | |
|---|---|---|---|
| CN | 2691348 | Y | 4/2005 |
| CN | 2761022 | Y | 3/2006 |
| CN | 201005208 | Y | 1/2008 |
| GB | 2 404 370 | A | 2/2005 |
| KR | 100735931 | B1 | 6/2007 |

* cited by examiner

*Primary Examiner* — David Walczak

(57) ABSTRACT

A pressable pen includes a tube body having a front end where a sealing unit, a cosmetic base, a cosmetic head and a cap are placed in order. An inner portion of the tube body includes an inner space to fill cosmetic materials, a plug unit, an elongated rod and a base. The base has a resilient unit, a guiding unit, a revolving unit and a pressing unit, wherein the pressing unit has short slots (slot one) and long slots (slot two) with different depth to align with a spacing column of the positioning unit to control the pressing unit. The guiding unit, revolving unit and positioning unit are equipped with associated inclined surfaces, and the guiding unit has a guiding rail to guide the elongated rod. The elongated rod has a spiral portion thereon to engage with a spiral through hole, such that the elongated rod is driven to rotate by the pressing unit and the movement of associated inclined surfaces. Since the elongated rod can only spirally rotate, the cosmetic materials in the tube body can be squeezed out by a spiral pressing process to efficiently control the situation of wrongfully-squeezing and precisely control the squeezed amount.

5 Claims, 5 Drawing Sheets

PRESSABLE PEN

FIELD OF THE INVENTION

This invention provides a new make-up tool, and more particularly a pressable pen that can control a press-to-squeeze process to transform the pressing process into a spiral feeding process to squeeze materials out of the pressable pen.

BACKGROUND OF THE INVENTION

Conventionally, cosmetic is usually stored in a soft tube. The problem of using the soft tube is that it is difficult to control whether or not the cosmetic is squeezed out and the amount squeezed out, such that it may be troublesome for a user to use the soft tube. Due to many wrongfully-squeezing situations, the cosmetics may leak out from the squeezed soft tube. Furthermore, since it is difficult to control the squeezed amount (e.g. either too little or too much), it may cause waste of the cosmetics.

Therefore, developing a practical and novel structure to overcome abovementioned problems is not only customers' desire, but also a goal for people in associated industries to achieve.

Under such circumstances, the inventor, who has experience in manufacturing and designing associated products for many years, achieves the goal mentioned above by generating the novel pressable pen in the present invention.

SUMMARY OF THE INVENTION

It is an object of the present invention to provide a make-up pen to solve abovementioned problems, such that the wrongfully-squeezing situation can be efficiently controlled and the squeezed amount can be precisely controlled.

A pressable pen used to solve abovementioned problems comprises:

- a tube body, having a front end where a sealing unit, a cosmetic base and a cosmetic head are placed in order, and an inner portion of the tube body having a space to fill cosmetic materials;
- a base, having a front surface with locking holes and a spiral through hole which is engaged with an elongated rod with a spiral portion thereon, and the elongated rod having a front end coupled with a plug unit, wherein the base is located at the inner portion of the tube body which closely contacts with the plug unit, and the base forms an inner space having a resilient unit therein;
- a guiding unit, having an outer surface with a protruding circle which is exactly against a free end of the resilient unit, and a plurality of protruding units extending from the protruding circle towards a rear end of the guiding unit, wherein an inclined surface is formed at a front end of each protruding unit, and a guiding rail in an inner portion of the guiding unit is engaged with a guiding slot of the elongated rod;
- a revolving unit, having a plurality of double-beveled surfaces at a front end thereof and enclosing the guiding unit while the double-beveled surfaces being engaged with the inclined surfaces in the guiding unit;
- a positioning unit, having a bottom surface with spacing columns, an engaging unit at a front end of the positioning unit to engage the locking hole of the base, and an inner inclined surface located at the inner surface of the positioning unit against the inclined surface of the guiding unit; and

- a pressing unit, having a plenty of equally-spaced short slots (slot one) and long slots (slot two) on a circumferential surface of the pressing unit, and exerting pressure on the revolving unit and the guiding unit, wherein either the short slot or the long slot is aligned with the spacing column of the positioning unit,
- wherein a cap placed at a circumferential surface of the cosmetic head of the front end of the tube body, is designed to seal with the sealing unit at the front end of the tube body,
- wherein the cosmetic is a brush,
- wherein the cosmetic is a lipstick, and
- wherein the inner portion of the tube body has a circular slot which can be wedged with a corresponding ring of the base, and the bottom of the base has a stopping element, which is placed around the bottom circumferential surface of the tube body.

Thus, the pressing unit causes the elongated rod to rotate by pressing associated inclined surfaces, and the elongated rod can only rotate spirally, so the materials in the tube body are squeezed out by the spiral movement of the elongated rod.

Comparing with conventional technique:

1. The pressable pen in the present invention does not have to worry about the problem of wrongfully-squeezing because when the slot one of the pressable pen is aligned with the spacing column of the positioning unit, the pressing unit cannot be pressed, which can efficiently control the situation of mis-squeezing.

2. The pressable pen in the present invention has consistent cosmetic output to efficiently control the squeezed amount, such that unnecessary cosmetic waste can be reduced and the squeezing process is easy to control.

The present invention together with the above and other advantages may best be understood from the following detailed description of the embodiments of the invention illustrated in the drawings below.

DETAILED DESCRIPTION OF THE INVENTION

Figure 1:
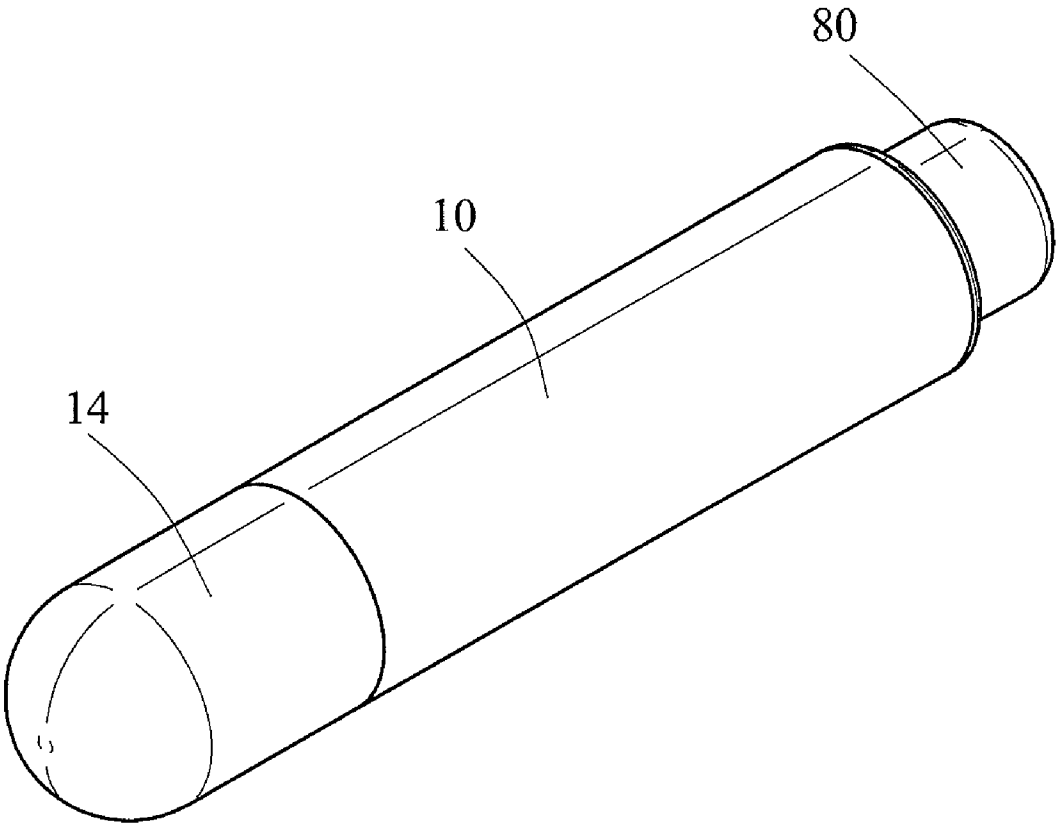
FIG. 1 is a three-dimensional view of one embodiment of the present invention.
Figure 2:
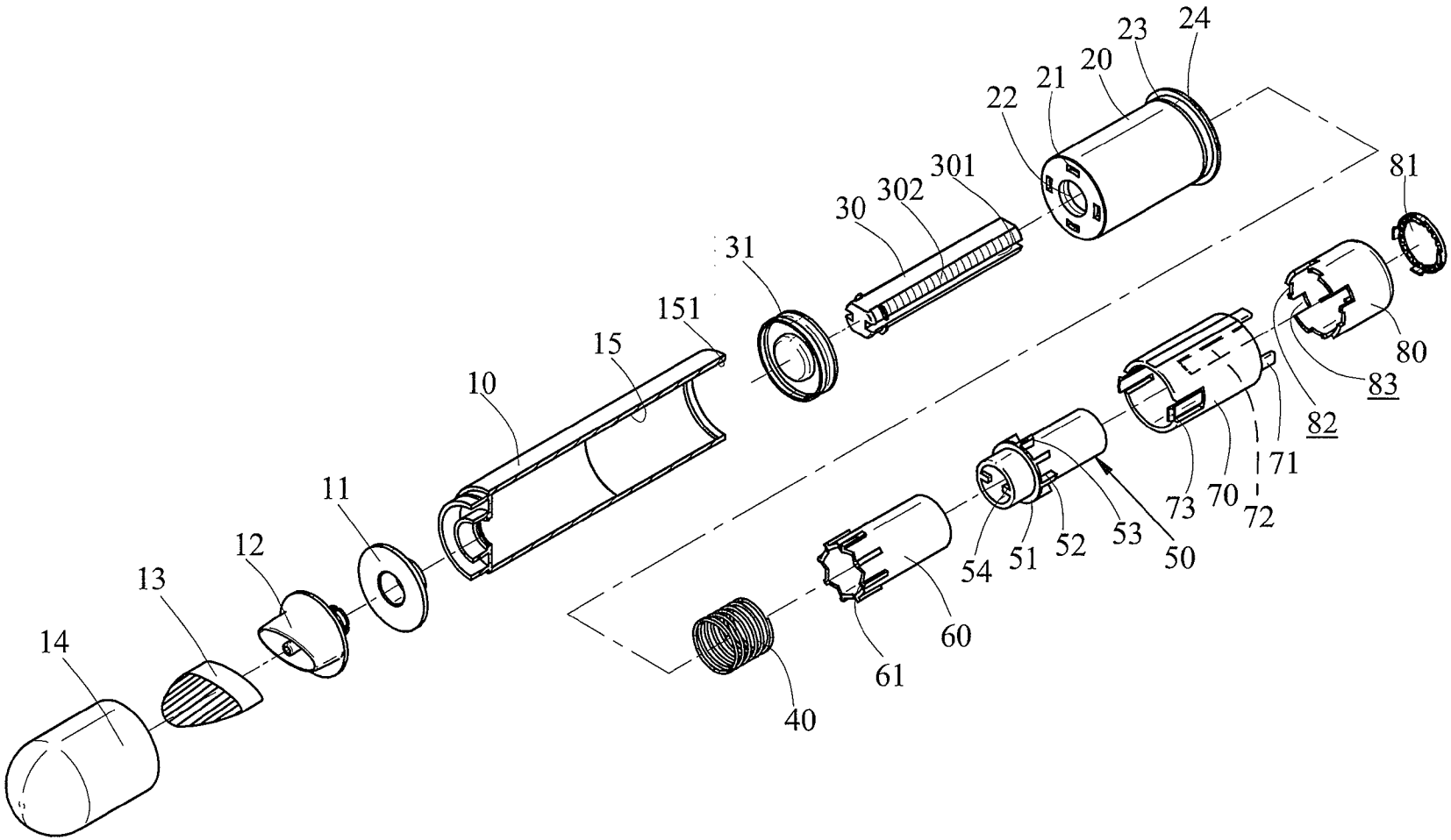
FIG. 2 is an exploded three-dimensional view of one embodiment of the present invention.

As illustrated in FIGS. 1 and 2, the present invention provides a pressable pen including:

- a tube body 10, having a front end where a sealing unit 11, a cosmetic base 12, a cosmetic head 13 and a cap 14 are placed in order, wherein the sealing unit 11 and the cap 14 can be engaged to seal the pressable pen, the cosmetic head 13 includes different kinds of cosmetic heads such as brushes or lipsticks; and an inner portion of the tube body has a space for filling materials;
- a base 20, having a front surface with locking holes 21 and a spiral through hole 22, the spiral through hole 22 engaged with an elongated rod 30 with a spiral portion 302 thereon, and the elongated rod 30 having a front end coupled with a plug unit 31, wherein the base 20 is located at the inner portion 15 of the tube body 10, such that the plug unit 31 closely contacts with the inner surface of the tube body 10, and the base 20 forms an inner space having a resilient unit 40 therein;

a guiding unit 50, having an outer surface with a protruding circle 51 which is exactly against a free end of the resilient unit 40 when the guiding unit 50 is enclosed in the inner space of the base 20, and a plurality of protruding units 52 extending from the protruding circle 51 towards a rear end of the guiding unit 50, wherein an inclined surface 53 is formed at a front end of each protruding unit 52, and a guiding rail 54 in an inner portion of the guiding unit 50 is engaged with a guiding slot 301 of the elongated rod 30;

a revolving unit 60, having a plurality of double-beveled surfaces 61 at a front end thereof, and enclosing the guiding unit 50 while the double-beveled surfaces 61 being engaged with the inclined surfaces 53 in the guiding unit 50;

a positioning unit 70 having a bottom surface with spacing columns 71, an engaging unit 73 to engage the locking hole 21 of the base 20, and an inner inclined surface 72 located at the inner surface of the positioning unit 70 against the inclined surface 53 of the guiding unit 50; and a pressing unit 80, having a plenty of equally-spaced short slots 82(slot one) and long slots 83 (slot two) on a circumferential surface of the pressing unit 80, and exerting pressure on the revolving unit 60 and the guiding unit 50.

The pressing unit 80 has a bottom surface with a cap set 81 thereon.

Figure 3:
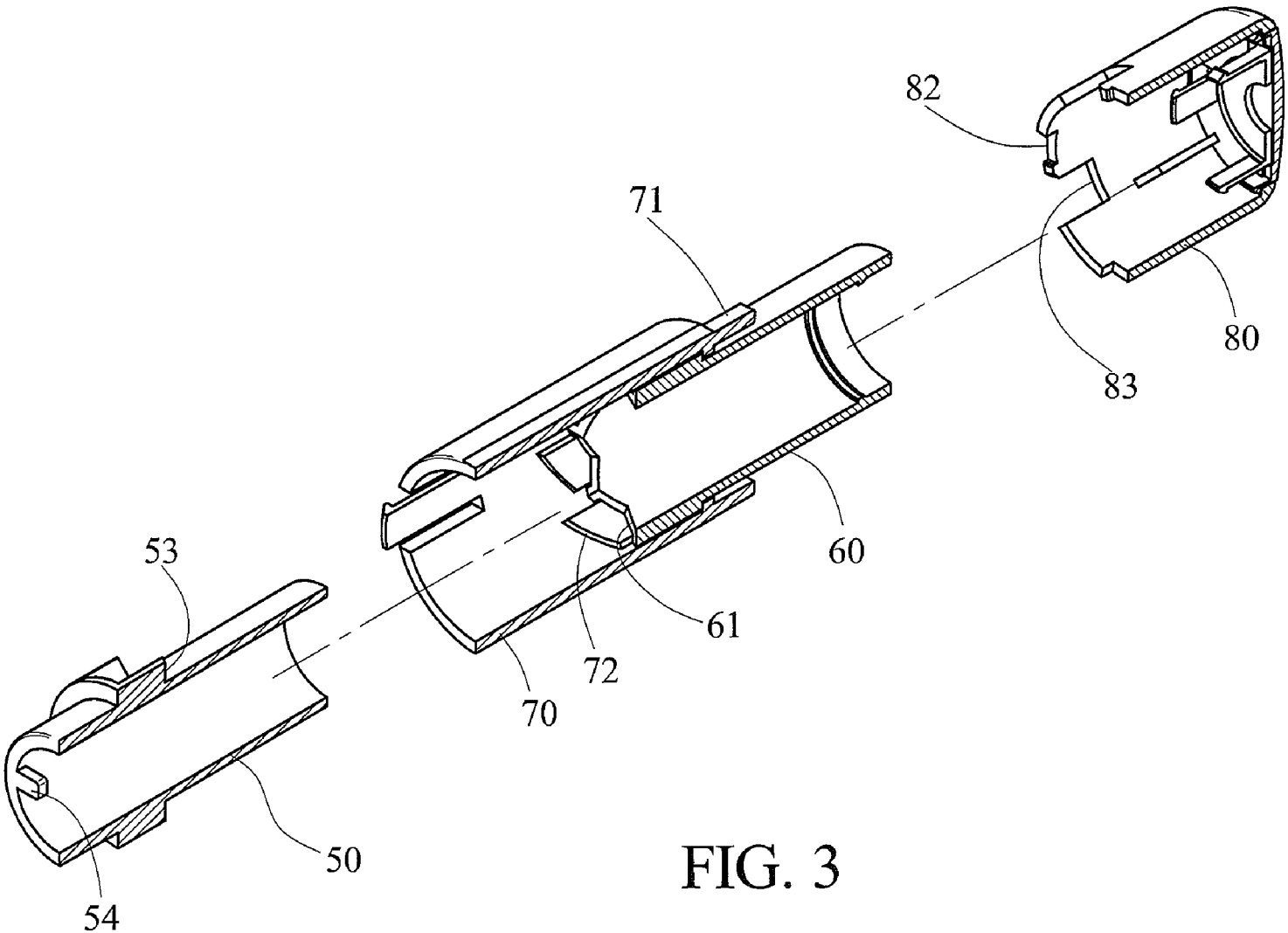
FIG. 3 is a partial sectional exploded three-dimensional view of one embodiment of the present invention.
Figure 4:
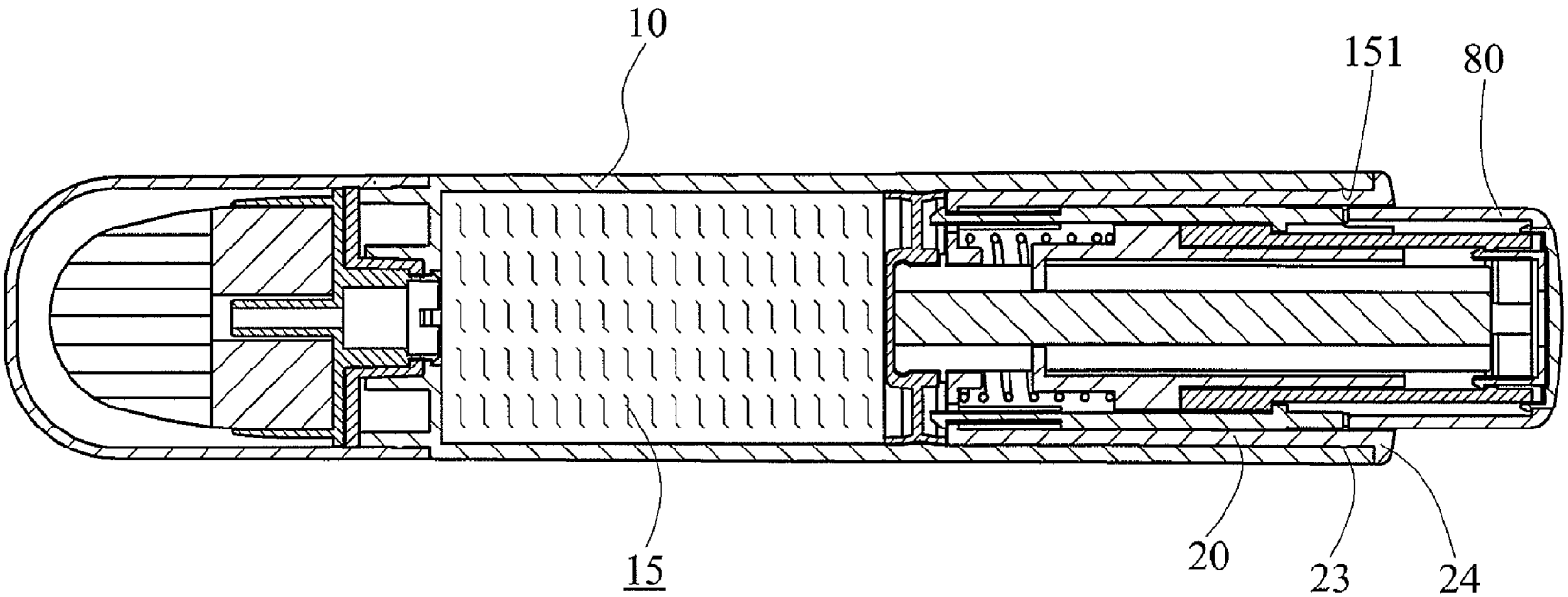
FIG. 4 is a sectional view of one embodiment of the present invention.

Referring to FIGS. 2, 3 and 4, a method to use the pressable pen in the present invention includes: twisting and selecting the short slot (slot one) 82 or long slot (slot two) 83 of the pressing unit 80 to align the spacing column 71 of the positioning unit 70, and when the short slot 82 of the pressing unit 80 is aligned with the spacing column 71 of the positioning unit 70, the pressing unit 80 cannot be pressed down.

Due to longer slot length of the long slot 83, when the long slot 83 of the pressing unit 80 is aligned with the spacing column 71, the pressing unit 80 can be pressed down to simultaneously push down the revolving unit 60 and the guiding unit 50. Because of interaction between the inclined surface 53 of the guiding unit 50 and the inner inclined surface 72 of the positioning unit 70 and the double-beveled surfaces 61 of the revolving unit 60, the guiding unit 50 can be twisted. Furthermore, the guiding rail 54 of the guiding unit 50, the elongated rod 30 and the guiding slot 301 of the elongated rod 30 are all twisted with the guiding unit 50. Since the base 20 is stationary, the elongated rod 30 with the spiral portion 302 is inserted into the spiral through hole 22 and pushed forward to the plug unit 31 to squeeze out the fluid materials stored in the inner portion 15 of the tube body 10. Also, the resilient unit 40 is used to restore the guiding unit 50, revolving unit 60 and the pressing unit 80 to their original positions.

Referring to FIG. 4, the inner portion 15 of the tube body 10 has a circular slot 151 which can be wedged with a corresponding ring 23 of the base 20. The bottom of the base 20 has a stopping element 24 located at the bottom circumferential surface of the tube body 10 to ensure the base would not fall into the inner portion 15 of the tube body 10.

Figure 6:
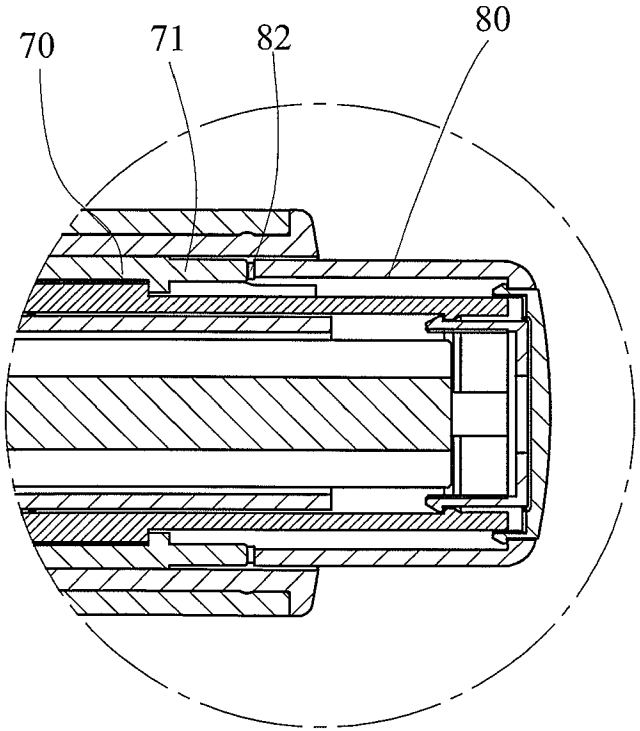
FIG. 6 is another partial sectional view of one embodiment of the present invention.
Figure 5:
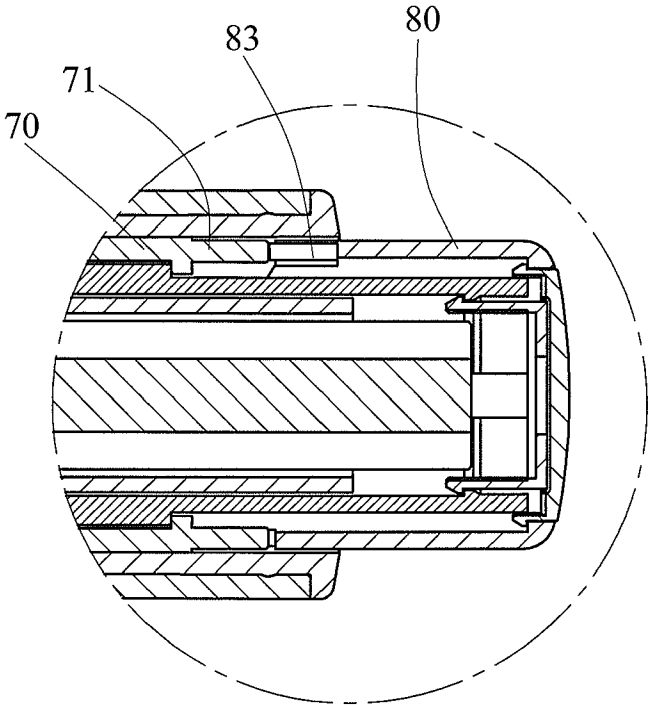
FIG. 5 is a partial sectional view of the one embodiment of the present invention.

As illustrated in FIGS. 5 and 6, when the short slot (slot one) 82 of the pressing unit 80 and the spacing column 71 of the positioning unit 70 are aligned, the pressing unit 80 cannot be pressed down, which would ensure there is no leakage of the fluid material due to wrongfully-squeezing (as shown in FIG. 6). In another aspect, when the pressing unit 80 rotates to align the long slot (slot two) 83 to the spacing column 71 of the positioning unit 70, the pressing unit 80 can be pressed down because the long slot 83 (slot two) has a deeper slot depth.

The above description is included to illustrate the operation of the preferred embodiments and is not meant to limit the scope of the invention. The scope of the invention is to be limited only by the following claims. From the above discussion, many variations will be apparent to one skilled in the relevant art that would yet be encompassed by the spirit and scope of the invention.

What is claimed is:

1. A pressable pen including:

a tube body, having a front end where a sealing unit, a cosmetic base and a cosmetic head are placed in order, and an inner portion of the tube body having a space to fill cosmetic materials;

a base, having a front surface with locking holes and a spiral through hole which is engaged with an elongated rod with a spiral portion thereon, and the elongated rod having a front end coupled with a plug unit, wherein the base is located at the inner portion of the tube body which closely contacts with the plug, and the base forms an inner space having a resilient unit therein;

a guiding unit, having an outer surface with a protruding circle which is exactly against a free end of the resilient unit, and a plurality of protruding units extending from the protruding circle towards a rear end of the guiding unit, wherein an inclined surface is formed at a front end of each protruding unit, and a guiding rail in an inner portion of the guiding unit is engaged with a guiding slot of the elongated rod;

a revolving unit, having a plurality of double-beveled surfaces at a front end thereof and enclosing the guiding unit while the double-beveled surfaces being engaged with the inclined surfaces in the guiding unit;

a positioning unit, having a bottom surface with spacing columns, an engaging unit at a front end of the positioning unit to engage the locking hole of the base, and an inner inclined surface located at the inner surface of the positioning unit against the inclined surface of the guiding unit; and a pressing unit, having a plenty of equally-spaced shorter first slots and long second slots on a circumferential surface of the pressing unit, and exerting pressure on the revolving unit and the guiding unit, wherein either the first slot or the second slot is aligned with the spacing column of the positioning unit.

2. The pressable pen of claim 1, wherein a cap placed at a circumferential surface of the cosmetic head of the front end of the tube body, is designed to seal with the sealing unit at the front end of the tube body.

3. The pressable pen of claim 1, wherein the cosmetic is a brush.

4. The pressable pen of claim 1, wherein the cosmetic is a lipstick.

5. The pressable pen of claim 1, wherein the inner portion of the tube body has a circular slot which can be wedged with a corresponding ring of the base, and the bottom of the base has a stopping element around the bottom circumferential surface of the tube body.

* * * * *